US008277000B2

(12) United States Patent
Huang

(10) Patent No.: US 8,277,000 B2
(45) Date of Patent: Oct. 2, 2012

(54) FRONT-MOUNT TYPE INTERLOCKING SLIDING RAIL ASSEMBLY

(75) Inventor: Kuo-Sheng Huang, Ying Ghor Town (TW)

(73) Assignee: Nan Juen International Co., Ltd., Taipei County (TW)

( * ) Notice: Subject to any disclaimer, the term of this patent is extended or adjusted under 35 U.S.C. 154(b) by 263 days.

(21) Appl. No.: 12/838,480

(22) Filed: Jul. 18, 2010

(65) Prior Publication Data

US 2012/0013234 A1 Jan. 19, 2012

(51) Int. Cl.
*E05C 7/06* (2006.01)

(52) U.S. Cl. ..... 312/221

(58) Field of Classification Search ..... 312/215, 312/216, 217, 218, 219, 221, 222
See application file for complete search history.

(56) References Cited

U.S. PATENT DOCUMENTS

| | | | | |
|---|---|---|---|---|
| 5,352,030 | A * | 10/1994 | Derle et al. | 312/221 |
| 6,932,445 | B2 * | 8/2005 | Chiu | 312/221 |
| 6,957,877 | B1 * | 10/2005 | Chiu | 312/221 |
| 6,979,064 | B2 * | 12/2005 | Chiu | 312/221 |
| 2004/0036387 | A1 * | 2/2004 | Ludwig et al. | 312/221 |
| 2005/0023941 | A1 * | 2/2005 | Chiu | 312/221 |
| 2007/0040484 | A1 * | 2/2007 | Huang | 312/221 |
| 2008/0074017 | A1 * | 3/2008 | Ruan et al. | 312/221 |
| 2008/0106175 | A1 * | 5/2008 | Huang | 312/217 |

* cited by examiner

*Primary Examiner* — Janet M Wilkens

(57) ABSTRACT

A front-mount type interlocking sliding rail assembly includes a sliding rail assembly formed of an outer rail, an intermediate rail and an inner rail, a bracket affixed to the outer rail, a swivel member pivoted to the bracket and having two opposite protruding blocks and an actuating block, first limiter and second limiter disposed at two opposite sides and movable by the swivel member, a switching block affixed to the inner rail and having two opposing wings respectively suspending in between a base portion and two stop flanges of the bracket, and a push member located on one wing and adapted for pushing the actuating block to bias the swivel member.

6 Claims, 12 Drawing Sheets

FRONT-MOUNT TYPE INTERLOCKING SLIDING RAIL ASSEMBLY

BACKGROUND OF THE INVENTION

1. Field of the Invention

The present invention relates to an interlock sliding rail assembly for drawer and more particularly, to a front-mount type interlocking sliding rail assembly that has the interlocking mechanism arranged at the front side, facilitating installation and repair.

2. Description of the Related Art

Drawers may be mounted in a vertical filing cabinet one above another. In this case, an interlock mechanism may be used to prevent the opening of more than one single drawer so that opening one single drawer will activate the interlocking mechanism to preclude the opening of the other drawers.

However, conventional interlocking sliding track assemblies are commonly of the rear mount type, i.e., the interlocking mechanism is installed in the rear side of the sliding track assembly. If the interlocking mechanism of a rear-mount type interlocking sliding rail assembly is damaged, it is difficult to remove the interlocking mechanism from the back side of the drawer for a replacement.

SUMMARY OF THE INVENTION

The present invention has been accomplished under the circumstances in view. It is the main object of the present invention to provide a front-mount type interlocking sliding rail assembly, which facilitates installation and repair of the interlocking mechanism.

It is another object of the present invention to provide a front-mount type interlocking sliding rail assembly, which assures positive interlocking operation of the interlocking mechanism.

To achieve these and other objects of the present invention, a front-mount type interlocking sliding rail assembly comprises a sliding rail assembly having an outer rail, an intermediate rail slidably mounted in the outer rail and an inner rail slidably mounted in the intermediate rail, a bracket affixed to the front end of the outer rail and having a base portion, two sidewalls spaced from the base portion at two opposite lateral sides and two stop flanges respectively protruded from the sidewalls, a swivel member pivotally connected to the bracket and having two protruding blocks disposed at two opposite ends thereof and an actuating block extended from one lateral side thereof, a first limiter and a second limiter disposed at two opposite sides and movable by the swivel member when the swivel member is biased relative to the bracket, a switching block affixed to the front end of the inner rail and having two wings disposed at two opposite lateral sides thereof and respectively suspending in between the base portion and stop flanges of the bracket, and a push member located on one wing and adapted for pushing the actuating block to bias the swivel member.

DETAILED DESCRIPTION OF THE PREFERRED EMBODIMENT

Figure 1:
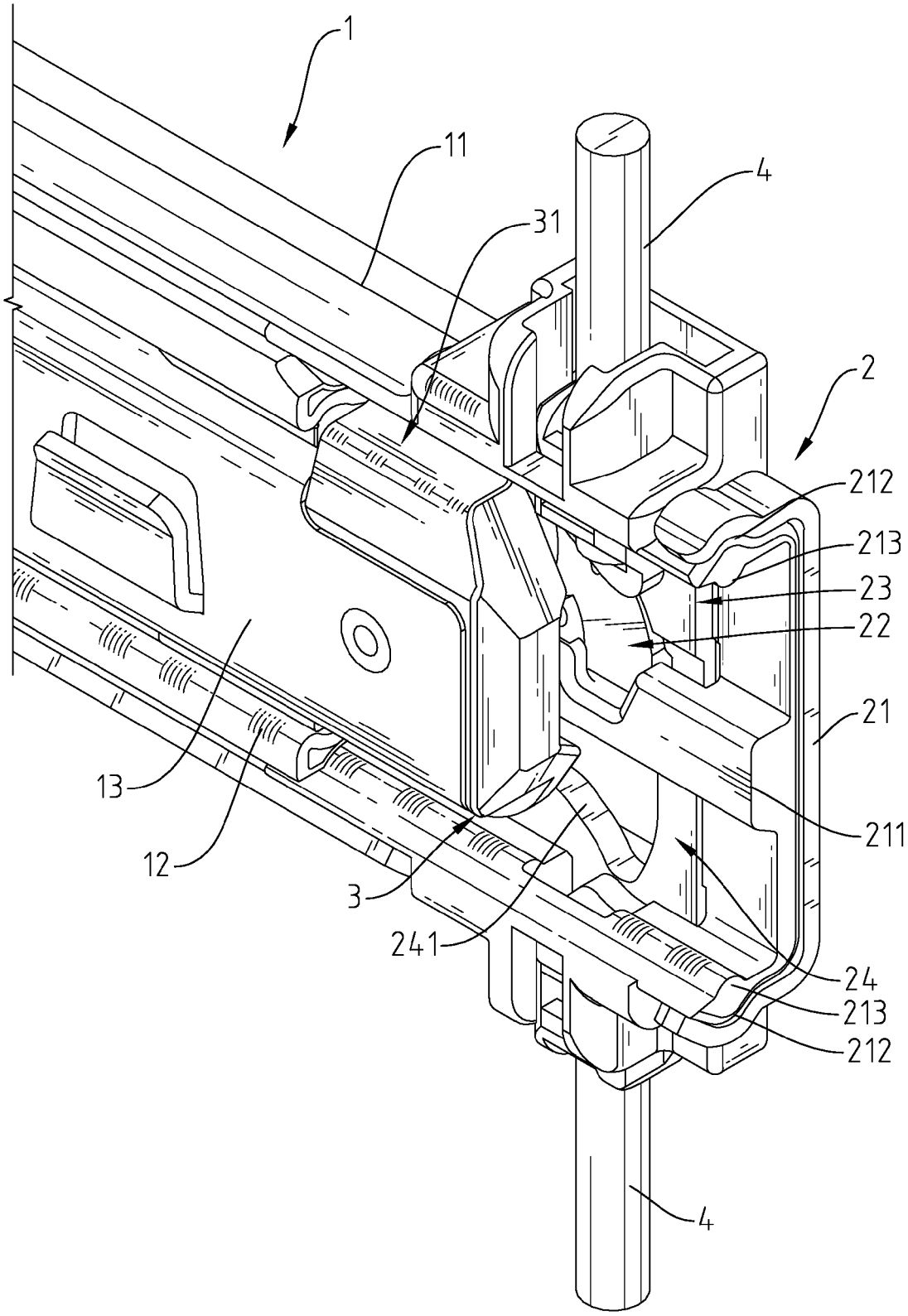
FIG. 1 is an oblique elevational view of a front-mount type interlocking sliding rail assembly in accordance with the present invention.
Figure 2:
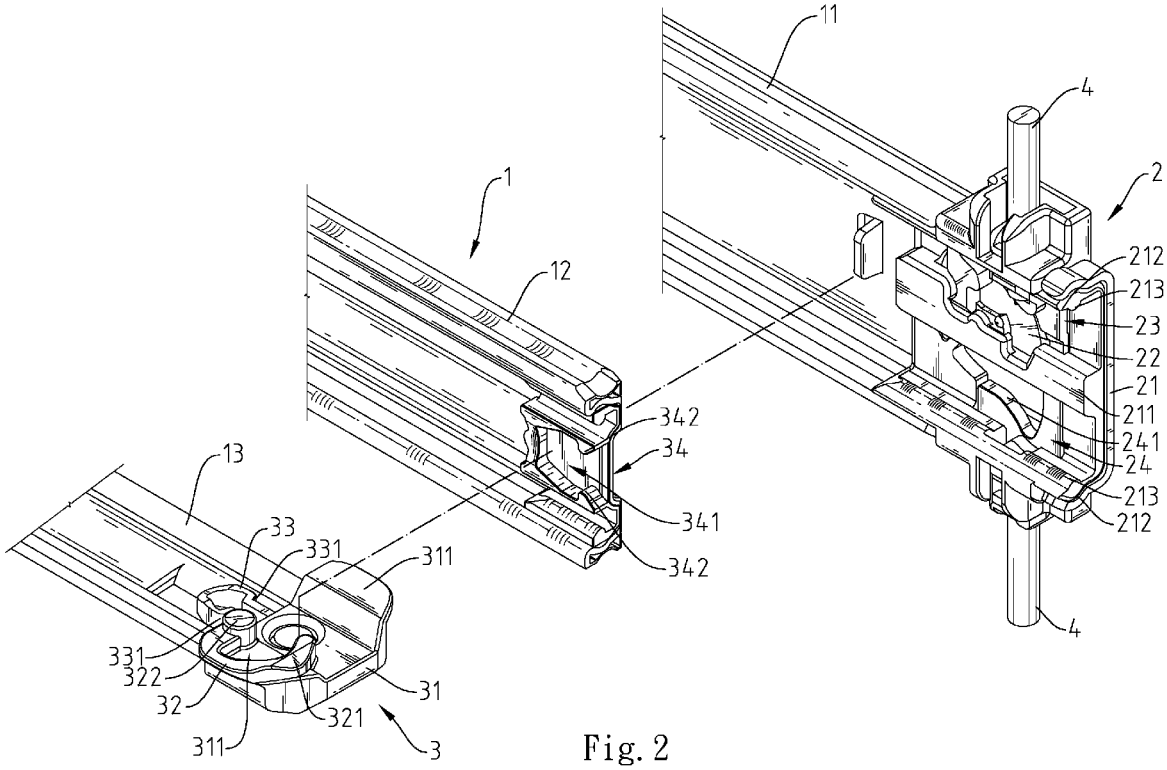
FIG. 2 is an exploded view of the front-mount type interlocking sliding rail assembly in accordance with the present invention.
Figure 3:
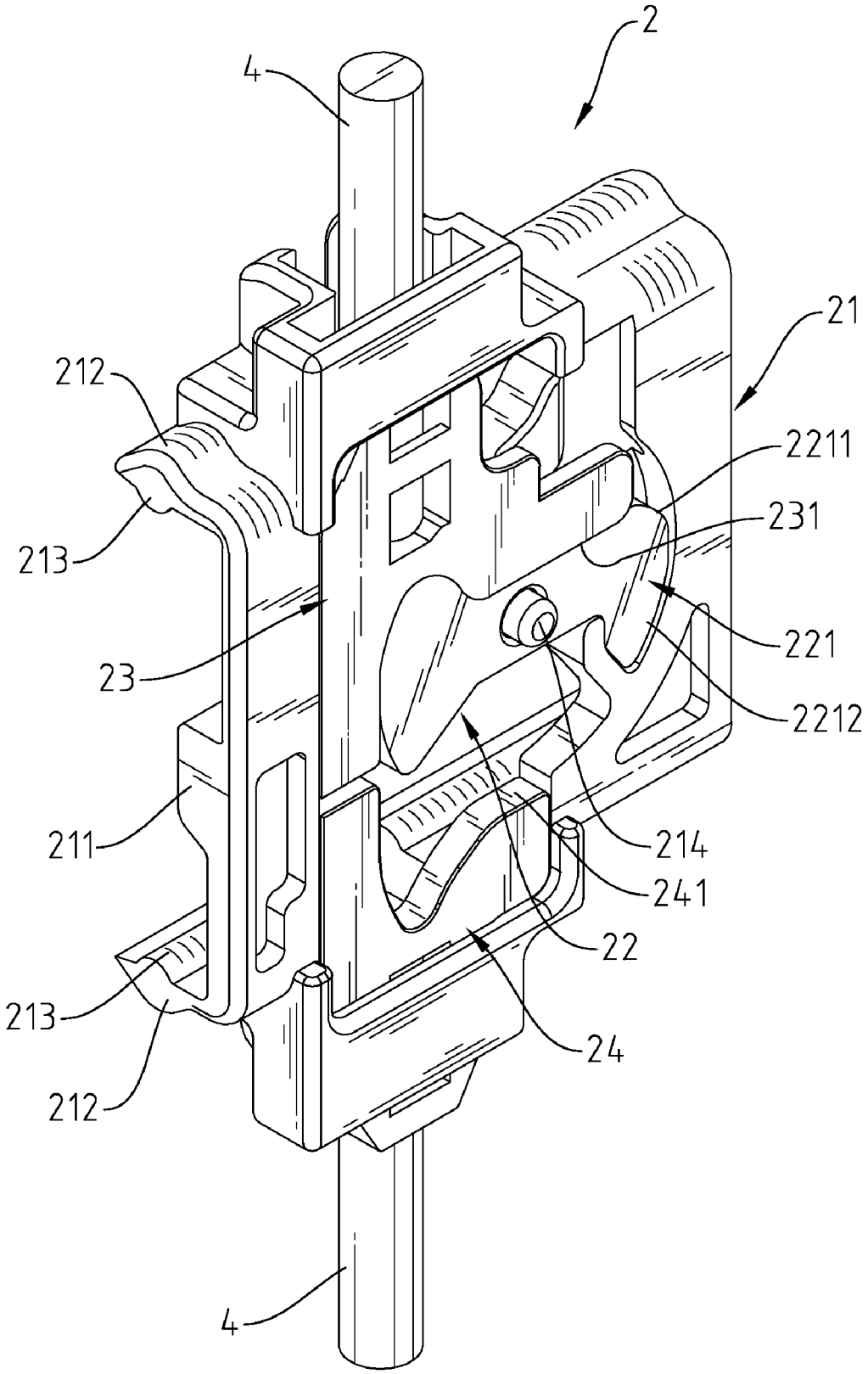
FIG. 3 is an elevational assembly view of the interlocking mechanism for the front-mount type interlocking sliding rail assembly in accordance with the present invention.
Figure 4:
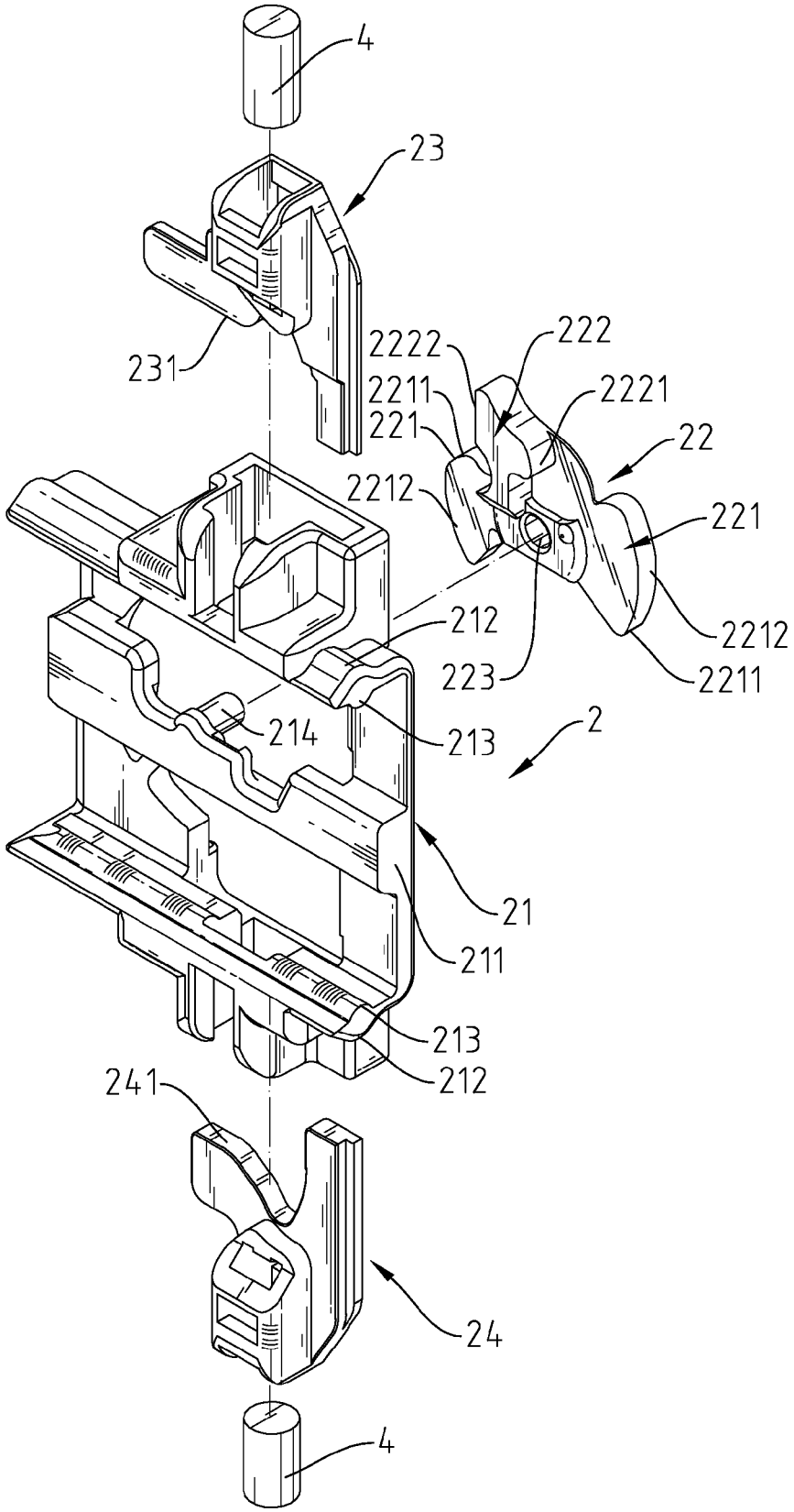
FIG. 4 is an exploded view of the interlocking mechanism for the front-mount type interlocking sliding rail assembly in accordance with the present invention.

Referring to FIGS. 1~4, a front-mount type interlocking sliding rail assembly in accordance with the present invention is shown comprising a sliding rail assembly 1, an interlocking mechanism 2 and a switching mechanism 3.

The sliding rail assembly 1 comprises an outer rail 11, an intermediate rail 12 axially slidably mounted in the outer rail 11 and an inner rail 13 axially slidably mounted in the intermediate rail 12.

The interlocking mechanism 2 comprises a bracket 21, a swivel member 22, a first limiter 23, and a second limiter 24. The bracket 21 is affixed to the front end of the outer rail 11, comprising a base portion 211, two sidewalls 212 respectively spaced from the base portion 211 at two opposite lateral sides in a parallel manner, two stop flanges 213 respectively protruded from the sidewalls 212 and facing the base portion 211, and a pivot pin 214 perpendicularly outwardly extended from the base portion 211. The swivel member 22 comprises a pivot hole 223 located on the middle and pivotally coupled to the pivot pin 214 of the bracket 21, two protruding blocks 221 symmetrically disposed at two opposite ends thereof, and an actuating block 222 extended from one lateral side thereof. Further, each protruding block 221 has a push face 2211, and a bearing face 2212 at one side of the push face 2211. Further, the actuating block 222 has a first bearing face 2221 disposed at one side, and a second bearing face 2222 opposing the first bearing face 2221. The first limiter 23 has a bearing face 231 disposed at one lateral side thereof adjacent to the swivel member 22. The second limiter 24 has a bearing face 241 disposed at one lateral side thereof adjacent to the swivel member 22.

The switching mechanism 3 comprises a switching block 31 affixed to the front end of the inner rail 13 and having two wings 311 disposed at two opposite lateral sides thereof and respectively suspending in between the base portion 211 and stop flanges 213 of the bracket 21, a push member 32 located on one wing 311 adjacent to the actuating block 222 of the swivel member 22 and having a first push block 321 and a second push block 322 that are disposed at two opposite sides and respectively connected to the distal end of the associating wing 311, a positioning block 33 extended from the switching block 31 remote from the front end of the inner rail 13 and defining two positioning grooves 331 at two opposite lateral sides thereof, and a locating block 34 fixedly mounted in the front end of the intermediate rail 12 and defining a mounting space 341 between two protruding portions 342 thereof.

Figure 5:
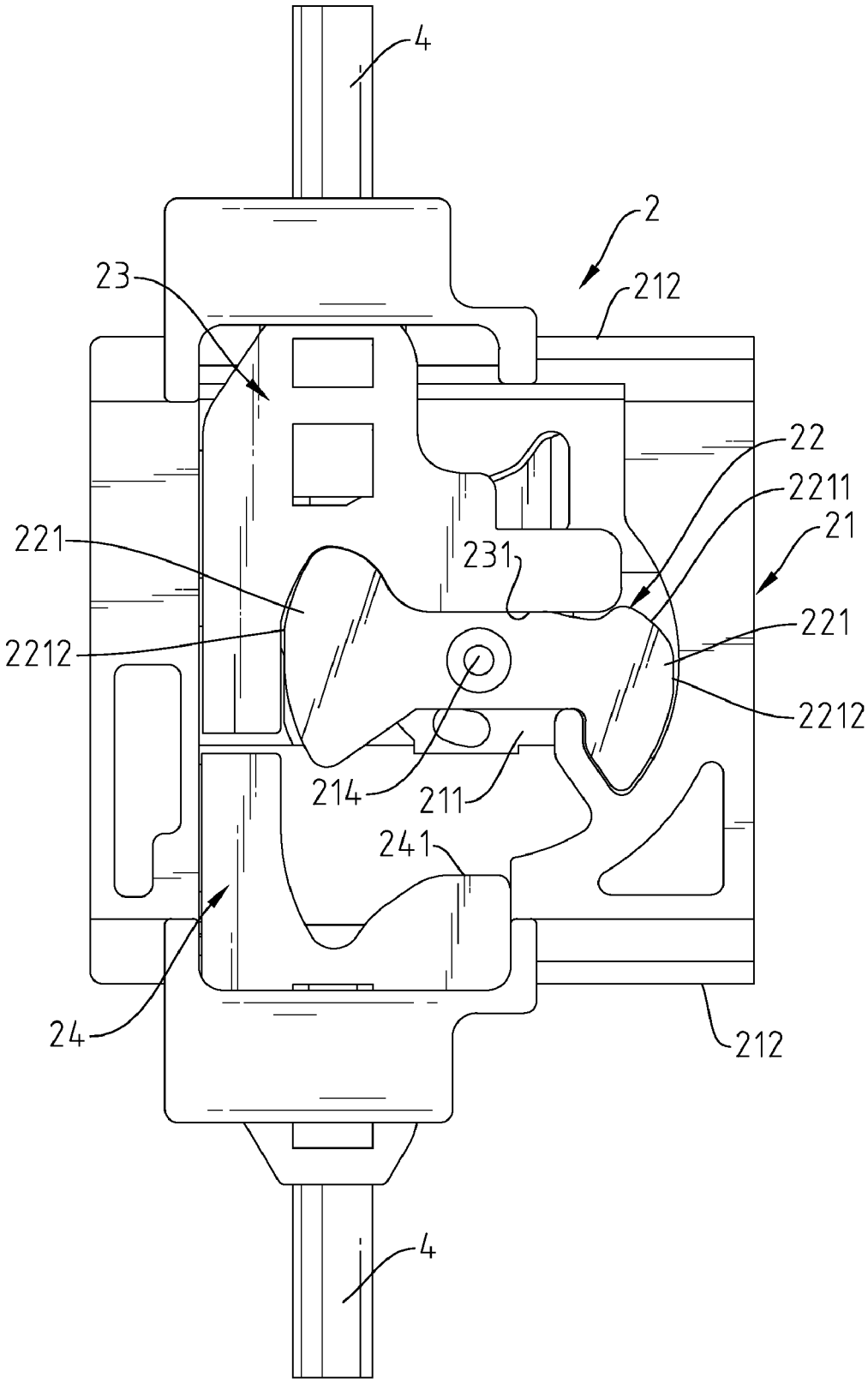
FIG. 5 is a side plain view of the present invention, showing the status of the interlocking mechanism when the sliding rail assembly closed.
Figure 6:
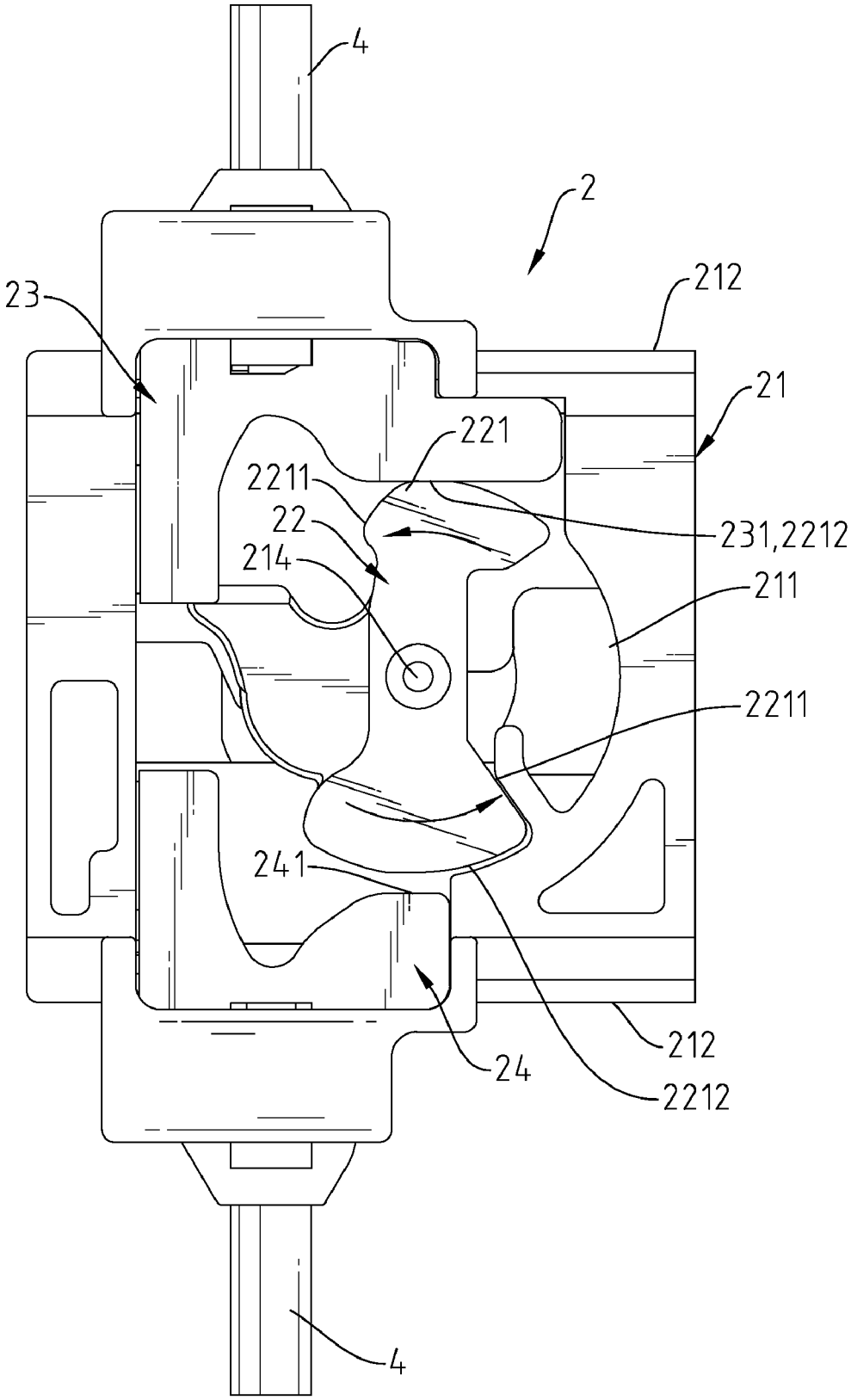
FIG. 6 is a side plain view of the present invention, showing the status of the interlocking mechanism when the sliding rail assembly opened.
Figure 7:
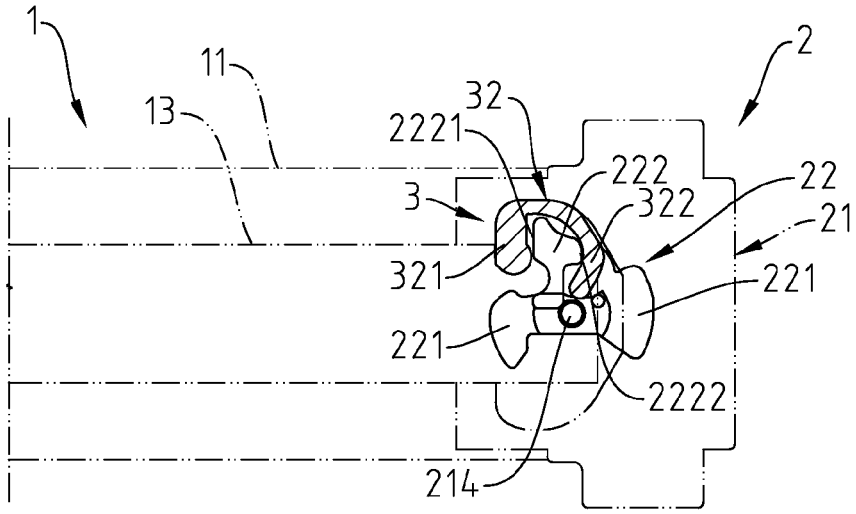
FIG. 7 is a schematic operation view of the present invention during opening of the sliding rail assembly (I).
Figure 8:
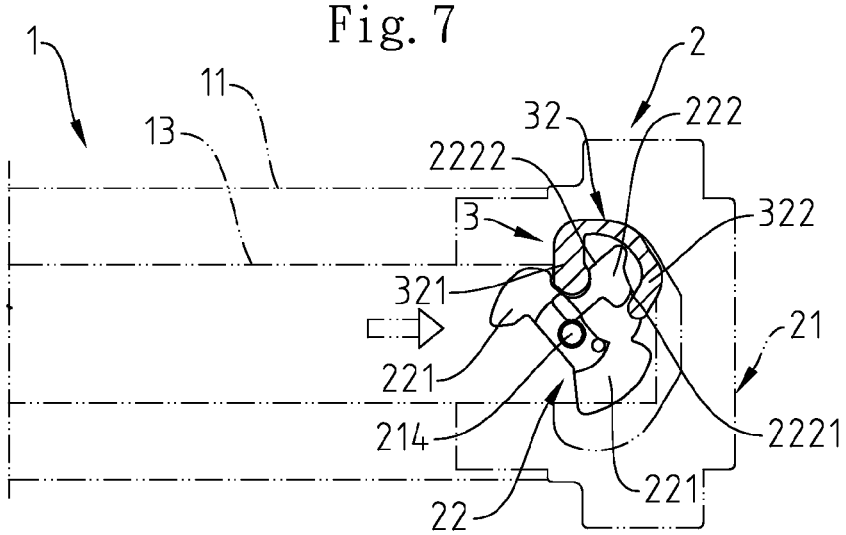
FIG. 8 is a schematic operation view of the present invention during opening of the sliding rail assembly (II).
Figure 9:
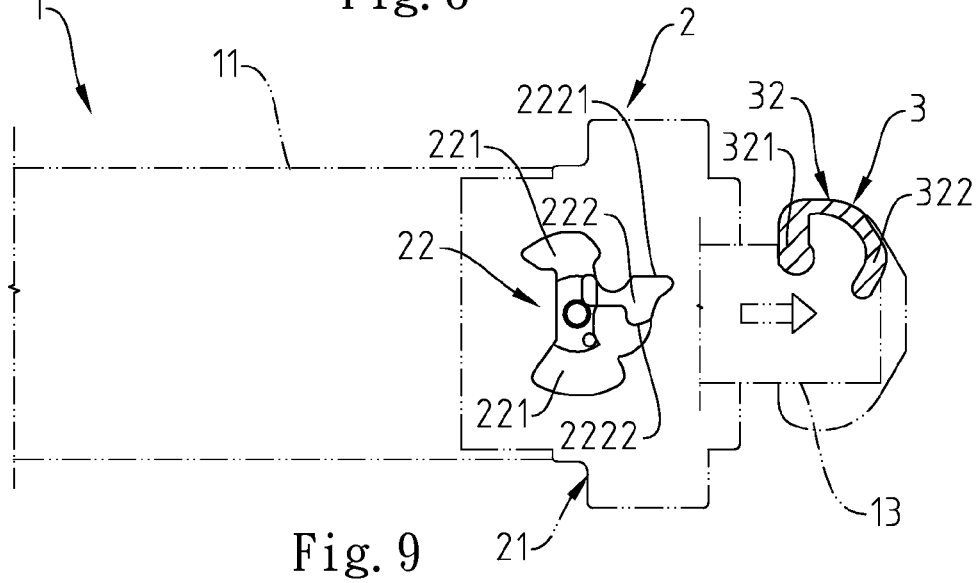
FIG. 9 is a schematic operation view of the present invention during opening of the sliding rail assembly (III).
Figure 10:
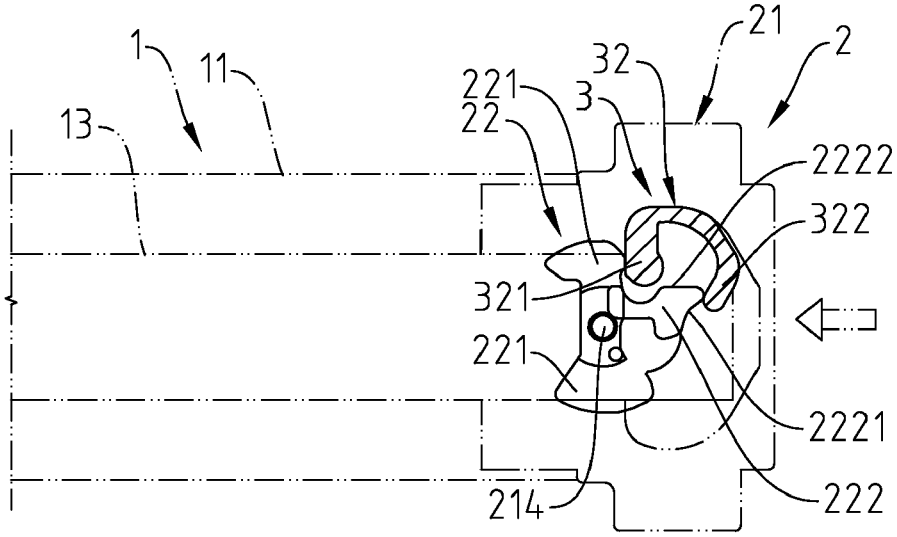
FIG. 10 is a schematic operation view of the present invention during closing of the sliding rail assembly (I).
Figure 11:
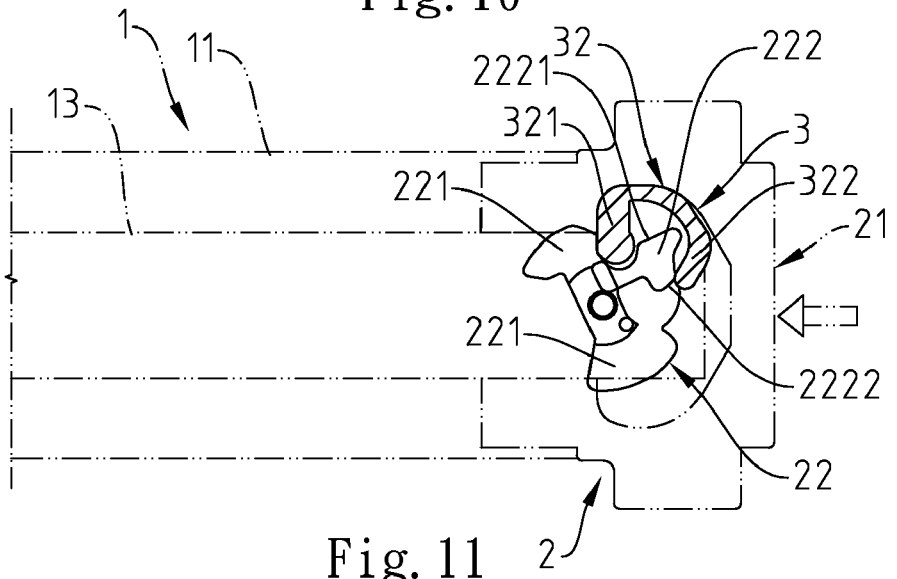
FIG. 11 is a schematic operation view of the present invention during closing of the sliding rail assembly (II).
Figure 12:
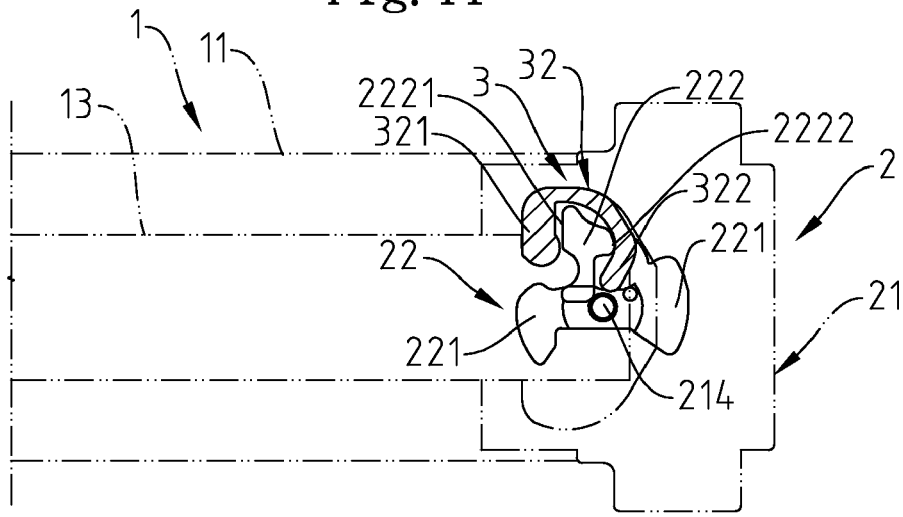
FIG. 12 is a schematic operation view of the present invention during closing of the sliding rail assembly (III).

Referring to FIGS. 5~9 and FIGS. 2 and 4 again, when the front-mount type interlocking sliding rail assembly is closed, as shown in FIG. 5, the protruding blocks 221 of the swivel member 22 are kept in horizontal, and the bearing face 231 of the first limiter 23 and the bearing face 241 of the second limiter 24 are not stopped by the bearing faces 2212 of the protruding blocks 221 of the swivel member 22, allowing upward and downward movement of the first limiter 23 and the second limiter 24. When the inner rail 13 is extended out of the outer rail 11, as shown in FIGS. 7~9, the actuating block 222 of the swivel member 22 is disposed between the first push block 321 and second push block 322 of the push member 32 of the switching mechanism 3. Therefore, when the inner rail 13 is pulled out of the outer rail 11 to carry the switching block 31 outwards, the second push block 322 of the push member 32 will push the second bearing face 2222 of the actuating block 222 to turn the swivel member 22 about the pivot pin 214 to a vertical position. During biasing of the swivel member 22, as shown in FIGS. 5 and 6, the push faces 2211 of the protruding blocks 221 of the swivel member 22 will push the bearing face 231 of the first limiter 23 and the bearing face 241 of the second limiter 24 respectively. When the swivel member 22 reaches the vertical position, the bearing faces 2212 of the protruding blocks 221 of the swivel member 22 will be stopped against the bearing face 231 of the first limiter 23 and the bearing face 241 of the second limiter 24 respectively, prohibiting movement of the first limiter 23 and the second limiter 24 relative to the bracket 21.

Figure 13:
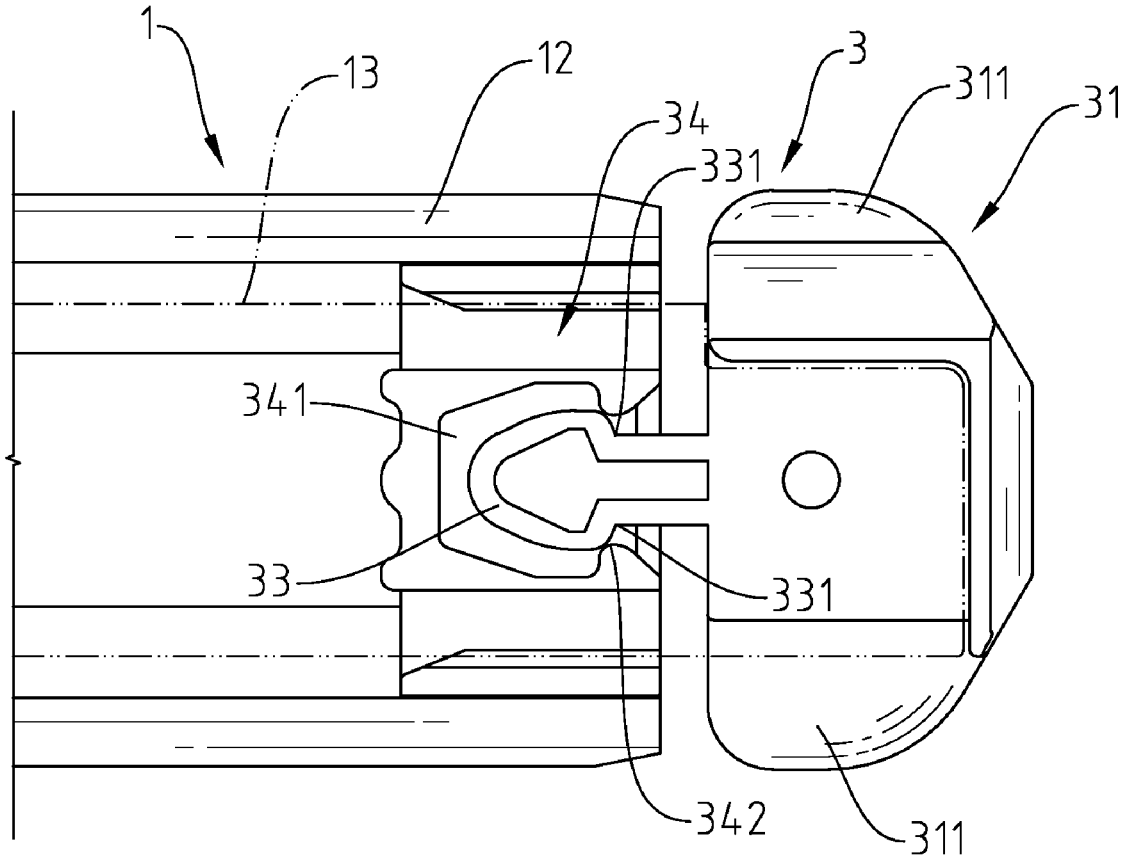
FIG. 13 is a schematic side view of the present invention, showing the status of the switching mechanism during outward movement of the inner rail from the intermediate rail.
Figure 14:
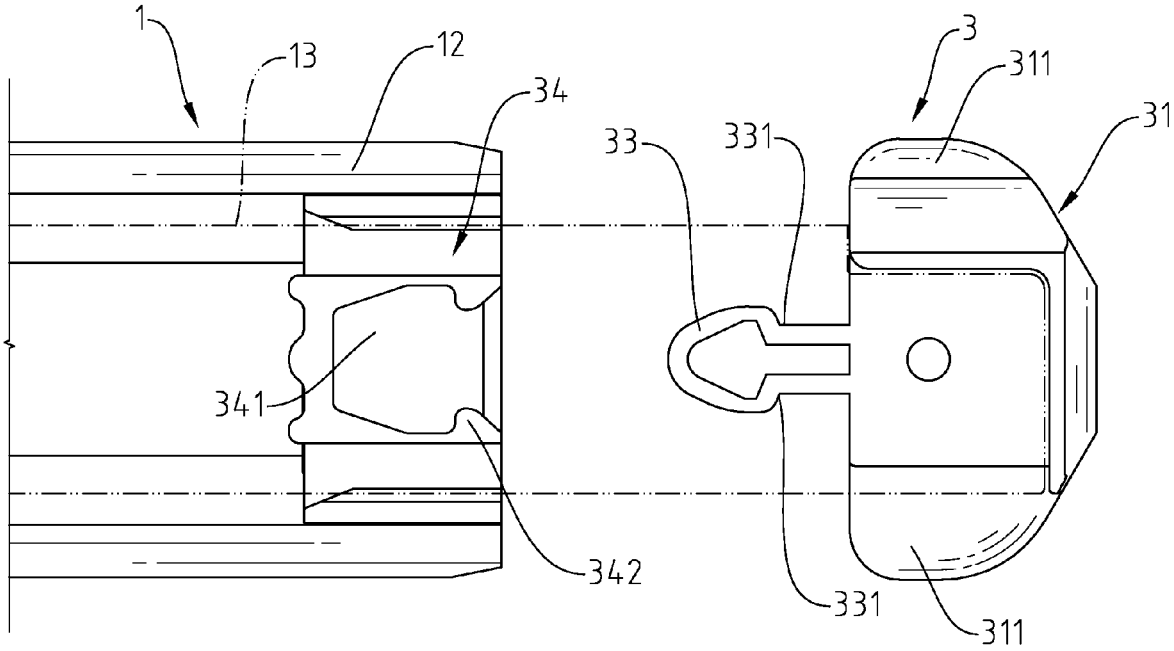
FIG. 14 is a schematic side view of the present invention, showing the status of the switching mechanism during inward movement of the inner rail relative to the intermediate rail.

Referring to FIGS. 13 and 14 and FIGS. 1 and 2 again, when pulling the inner rail 13 out of the outer rail 11, the intermediate rail 12 will be carried by the inner rail 13 due to that the positioning grooves 331 of the positioning block 33 of the switching mechanism 3 are engaged with the protruding portions 342 of the locating block 34. When the intermediate rail 12 is fully pulled out of the outer rail 11 by the inner rail 13, the positioning grooves 331 of the positioning block 33 of the switching mechanism 3 will be disengaged from the protruding portions 342 of the locating block 34, allowing the inner rail 13 to be moved along the intermediate rail 12 (see FIG. 14).

Referring to FIGS. 10~12 and FIG. 2 and FIGS. 4~6 again, when closing the front-mount type interlocking sliding rail assembly, push the inner rail 13 toward the inside of the outer rail 11. When the push block of the switching mechanism 3 approaches the actuating block 222 of the swivel member 22, the first push block 321 and second push block 322 of the push member 32 will push the first bearing face 2221 of the actuating block 222 and the protruding block 221 of the swivel member 22, causing the swivel member 22 to be turned about the pivot pin 214 from the vertical position to the horizontal position, and therefore the first limiter 23 and the second limiter 24 are unlocked for movement in reversed directions.

Figure 15:
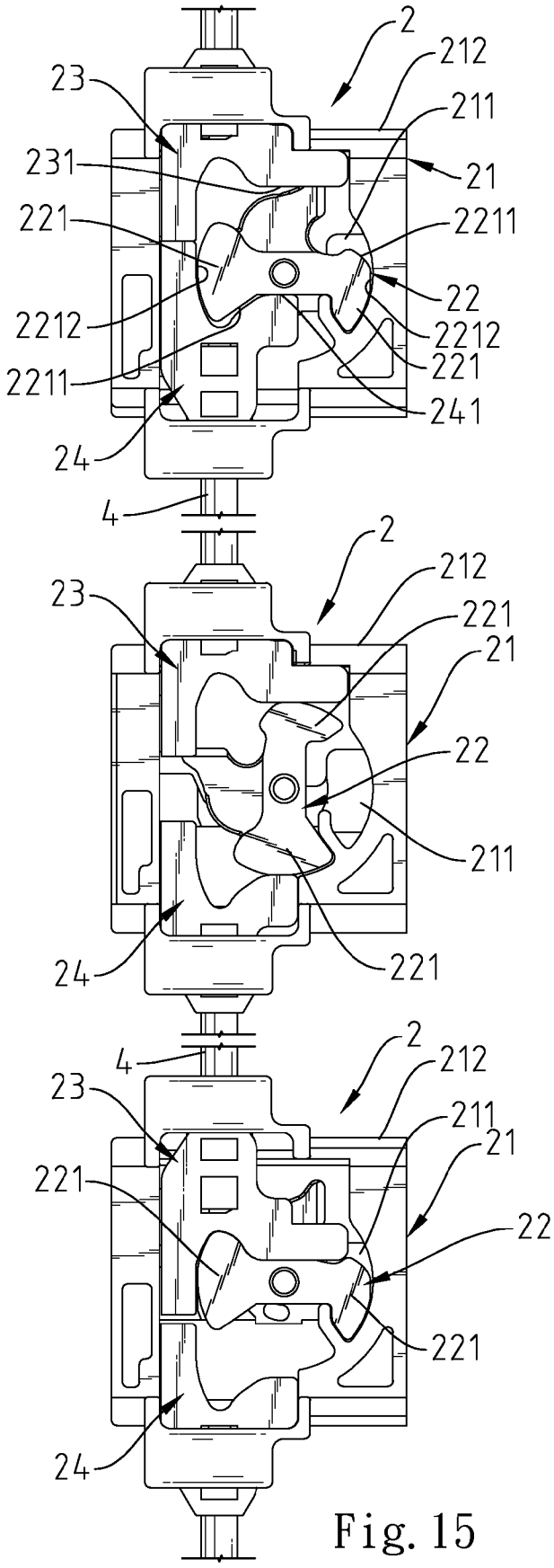
FIG. 15 is an applied view of the present invention, showing multiple front mount type interlocking sliding rail assembly linked in a parallel manner.

Referring to FIG. 15 and FIGS. 1 and 2 again, when multiple front-mount type interlocking sliding rail assembles are used together and arranged in a parallel manner, a stop bar 4 is connected between the first limiter 23 of one front-mount type interlocking sliding rail assembly and the second limiter 24 of another front-mount type interlocking sliding rail assembly. Thus, when one front-mount type interlocking sliding rail assembly is opened, the first limiter 23 and second limiter 24 of the respective front-mount type interlocking sliding rail assembly are forced by the bearing faces 2212 of the protruding blocks 221 of the respective swivel member 22 to move upwards or downwards, and each stop bar 4 pushes the adjacent first limiter 23 or second limiter 24 toward the associating swivel member 22, prohibiting opening of each adjacent front-mount type interlocking sliding rail assembly.

Figure 16:
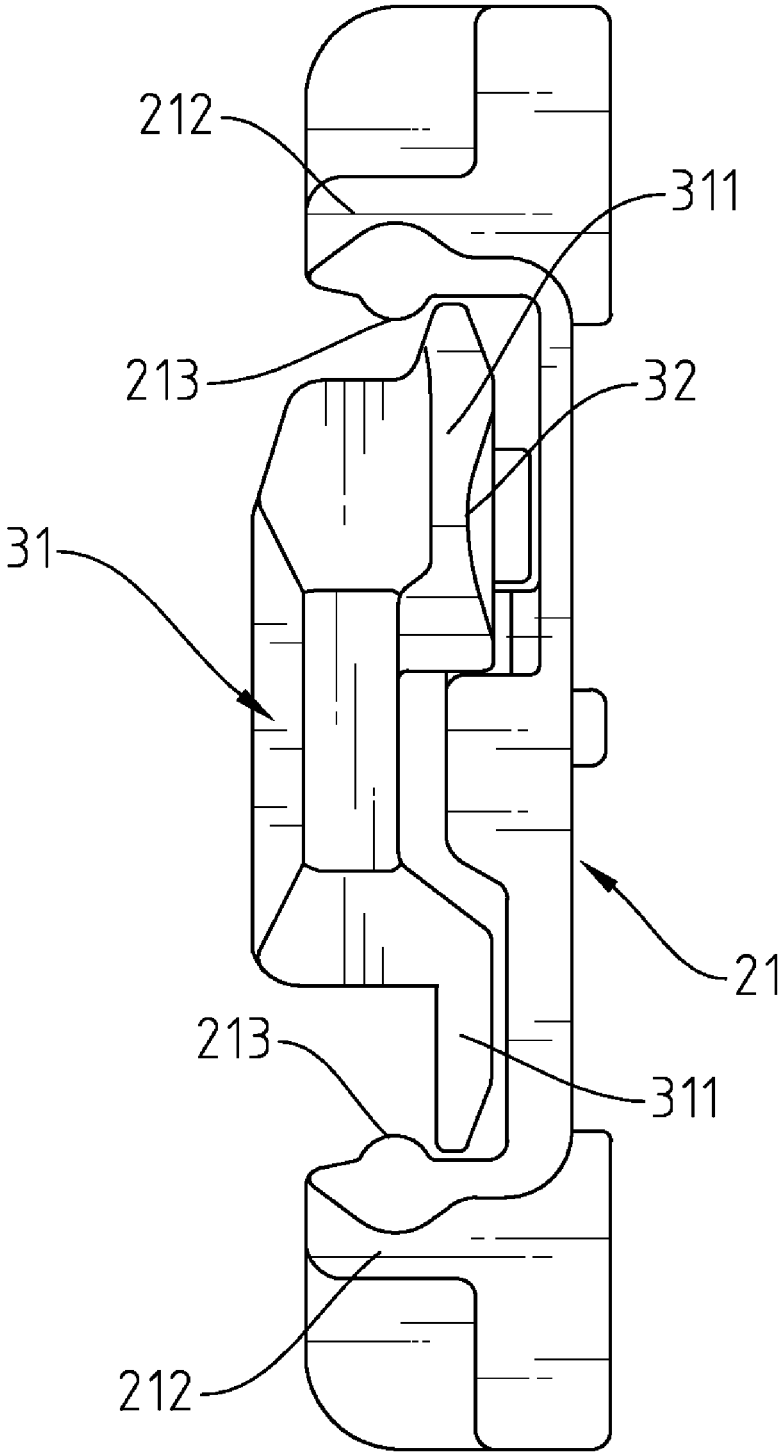
FIG. 16 is a schematic side view of the present invention, showing the relationship between the switching block and the bracket.

Referring to FIG. 16 and FIGS. 2 and 4 again, because the two wings 311 of the switching block 31 are disposed at the two opposite lateral sides thereof and respectively suspending in between the base 211 and stop flanges 213 of the bracket 21, the wings 311 are constrained by the base 211 and stop flanges 213 of the bracket 21 to move with the inner rail 13 stably so that the push block 32 of the switching mechanism 3 can push the protruding blocks 221 of the swivel member 22 to turn the swivel member 22 about the pivot pin 214 accurately. Further, because the first push block 321 and second push block 322 of the push member 32 are located on one wing 311, the push member 32 reinforces the structural strength of the associating wing 311. Further, because first push block 321 and second push block 322 of the push member 32 are respectively connected to the distal ends of the associating wing 311, the wing 311 reinforces the structural strength of the push member 31 against deformation, assuring positive working against the protruding blocks 221 of the swivel member 22.

Although one particular embodiment of the invention has been described in detail for purposes of illustration, various modifications and enhancements may be made without departing from the spirit and scope of the invention.

What the invention claimed is:

1. A front-mount type interlocking sliding rail assembly, comprising:

a sliding rail assembly, said sliding rail assembly comprising an outer rail, an intermediate rail slidably mounted in said outer rail and movable in and out of said outer rail and an inner rail slidably mounted in said intermediate rail and movable in and out of said intermediate rail;

an interlocking mechanism, said interlocking mechanism comprising a bracket affixed to a front end of said outer rail, said bracket comprising a base portion, two sidewalls respectively spaced from said base portion at two opposite lateral sides in a parallel manner and two stop flanges respectively protruded from said sidewalls and facing said base portion, a swivel member pivotally connected to said base portion of said bracket, said swivel member comprising two protruding blocks symmetrically disposed at two opposite ends thereof and an actuating block extended from one lateral side thereof, and a first limiter and a second limiter disposed at two opposite sides relative to said swivel member and movable by the swivel member when said swivel member is biased relative to said bracket; and a switching mechanism, said switching mechanism comprising a switching block affixed to a front end of said inner rail and having two wings disposed at two opposite lateral sides thereof and respectively suspending in between said base portion and said stop flanges of said bracket, a push member adapted for pushing said actuating block of said swivel member to bias said swivel member relative to said bracket, said push member having a first push block and a second push block disposed at two opposite sides.

2. The front-mount type interlocking sliding rail assembly as claimed in claim 1, wherein said first push block and said second push block of said push member are respectively connected to a distal end of the associating wing.

3. The front-mount type interlocking sliding rail assembly as claimed in claim 1, wherein said bracket further comprises a pivot pin extended from said base portion; said swivel member has a pivot hole located on a middle part thereof and pivotally coupled to said pivot pin of said bracket.

4. The front-mount type interlocking sliding rail assembly as claimed in claim 1, wherein said first limiter and said second limiter each have a bearing face; the protruding blocks of said swivel member each have a push face adapted for pushing the bearing faces of said first limiter and said second limiter to move said first limiter and said second limiter away from said bracket and a bearing face for stopping against bearing faces of said first limiter and said second limiter.

5. The front-mount type interlocking sliding rail assembly as claimed in claim 1, wherein said push member is located on one wing adjacent to said actuating block of said swivel member; said actuating block of said swivel member comprises a first push face pushable by said first push block of said push member and a second push face pushable by said second push block of said push member.

6. The front-mount type interlocking sliding rail assembly as claimed in claim 1, wherein said switching mechanism further comprises a locating block fixedly mounted in a front end of said intermediate rail, said locating block comprising a mounting space and two protruding portions at two sides of said mounting portion, and a positioning block extended from said switching block, said positioning block comprising two positioning grooves disposed at two opposite lateral sides thereof and respectively engaged with the protruding portions of said locating block.

* * * * *